US005160801A

United States Patent [19]

Andersen et al.

[11] Patent Number: 5,160,801

[45] Date of Patent: Nov. 3, 1992

[54] POWERLESS PROGRAMMABLE FUZE FUNCTION MODE SYSTEM

[75] Inventors: David A. Andersen, Mound; Keith A. Kiefer, Ramsey; Leonard D. Hones, Eden Prairie, all of Minn.

[73] Assignee: Alliant Techsystems Inc., Minneapolis, Minn.

[21] Appl. No.: 702,988

[22] Filed: May 20, 1991

[51] Int. Cl.[5] ..... F42C 17/04

[52] U.S. Cl. ..... 89/6; 102/270; 102/206

[58] Field of Search ..... 89/6, 6.5; 102/270, 102/271, 265, 206

[56] References Cited

U.S. PATENT DOCUMENTS

| | | | |
|---|---|---|---|
| H466 | 5/1988 | Reiter | 102/200 |
| 3,793,957 | 2/1974 | Stout et al. | 102/215 |
| 3,967,557 | 7/1976 | Irish, Jr. | 102/70.2 R |
| 3,977,329 | 8/1976 | Wilde | 89/6 |
| 4,022,102 | 5/1977 | Ettel | 89/6.5 |
| 4,237,789 | 12/1980 | Stauers et al. | 102/270 |
| 4,240,350 | 12/1980 | Münzel et al. | 102/215 |
| 4,488,370 | 12/1984 | Lemelson | 42/70 R |
| 4,580,498 | 4/1986 | Abt et al. | 102/215 |
| 4,649,796 | 3/1987 | Schmidt | 89/6.5 |
| 4,651,647 | 3/1987 | Baker | 102/213 |
| 4,664,013 | 5/1987 | Wegner et al. | 89/6.5 |
| 4,686,885 | 8/1987 | Bai | 89/6.5 |
| 4,711,152 | 12/1987 | Fortunko | 89/6.5 |
| 4,730,794 | 3/1988 | Knauer | 89/6.5 |

FOREIGN PATENT DOCUMENTS

| | | | |
|---|---|---|---|
| 42595 | 1/1910 | Austria | 89/6.5 |
| 286270 | 7/1931 | Italy | 89/6 |

*Primary Examiner*—Stephen M. Johnson
*Attorney, Agent, or Firm*—John R. Flanagan

[57] ABSTRACT

A system for programming the function mode of a munition fuze without supplying electrical power to the fuze includes an arrangement of programmable elements located internally of the munition that are electrically conductive but which remain electrically unpowered until after munition firing, and a programming mechanism located externally of the munition being operable to mechanically program the conductive elements. The programmable elements are a series of concentric bands attached to the interior of the munition casing and spaced from one another along the munition axis and separated from casing wall by an electrically insulating layer. The programming mechanism is a plurality of punch heads aligned with the concentric bands and capable of being actuated such that only selected ones of the punch heads strike the exterior of the munition casing causing an indentation in the casing that penetrates the insulating layer and makes electrical contact with the selected ones of the concentric bands. By maintaining the munition casing at a common potential, a coded binary sequence of opened and closed switches is formed by the concentric bands setting the function mode of the fuze which can be subsequently read once electrical power is generated upon munition firing.

12 Claims, 2 Drawing Sheets

POWERLESS PROGRAMMABLE FUZE FUNCTION MODE SYSTEM

BACKGROUND OF THE INVENTION

1. Field of the Invention

The present invention generally relates to techniques for setting a fuze to explode a munition after launch and, more particularly, is concerned with a system for programming data relating to the function mode of the fuze without supplying electrical power to the fuze.

2. Description of the Prior Art

For improving the probability of hitting a target, it is advantageous to be able to program the function time of a fuze of a munition that will be fired at the target at a moment close to the time of firing of the munition. Many techniques are disclosed in the prior art for this purpose. Representative of the prior art techniques are the ones disclosed in U.S. Pat. Nos. to Irish, Jr. (3,967,557), Ettel (4,022,102), Stauers et al (4,237,789), Munzel et al (4,240,350) Abt et al (4,580,498). Schmidt (4,649,796), Baker (4,651,647), Wegner et al (4,664,013), Bai (4,686,885) and Fortunko (4,711,152).

These prior art techniques typically employ an electronic circuit onboard the munition to which electomagnetic energy must be transmitted to electrically program and establish the function time of the fuze. This requires the supply of electrical power to the location of the fuze before firing of the munition which increases the risk of a malfunction which could be detrimental to the safety of personnel and equipment. The use of an electronic circuit to program the fuze function time also requires the provision of specific hardware for this purpose which adds weight and complexity to the munition fuze.

Consequently, a need exists for improvement in programming of munition fuze function time that will avoid the above-described drawbacks associated with these prior art techniques.

SUMMARY OF THE INVENTION

The present invention provides a powerless programmable fuze function mode system designed to satisfy the aforementioned needs. The powerless programming system of the present invention employs programmable means including an arrangement of programmable elements located internally of the munition. The programmable elements are electrically conductive but remain electrically passive until after munition firing. Thus, the programmable elements need not be supplied with electrical power at the time of programming them in order to supply the data to set the function mode of the munition fuze.

The powerless programming system of the present invention also employs an externally-located programming mechanism which supplies the mechanical, as opposed to electrical, power necessary to program the conductive programmable elements to set the function mode of the munition fuze without supplying electrical power to the conductive elements nor the munition fuze. the function mode of the munition fuze can include, but is not limited to, time of flight, proximity to target, impact delay, etc.

More particularly, the programmable means includes an annular portion of the munition casing and an electrically insulating layer attached to the interior of the munition casing annular portion. The programmable elements are a series of conductive concentric bands supported by the insulating layer in spaced relation to one another along the munition axis and inwardly spaced relation to casing annular portion.

Further, the programming mechanism includes a plurality of punch heads, and a plurality of drivers movably mounting the punch heads and being disposed along the exterior of the annular portion of the munition casing and aligning the punch heads with the programmable bands. The punch heads are capable of being actuated by the drivers such that only those punch heads selected (being among many different combinations) will strike the exterior of the annular portion of the munition casing causing an indentation therein that penetrates the insulating layer and makes electrical contact of the casing with the preselected ones of the programmable bands aligned with the selected punch heads. By maintaining the munition casing annular portion at a common potential, a coded binary sequence of opened and closed switches is formed by the concentric bands setting the function mode of the munition fuze which can be subsequently read once electrical power is generated upon munition firing.

These and other features and advantages of the present invention will become more apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
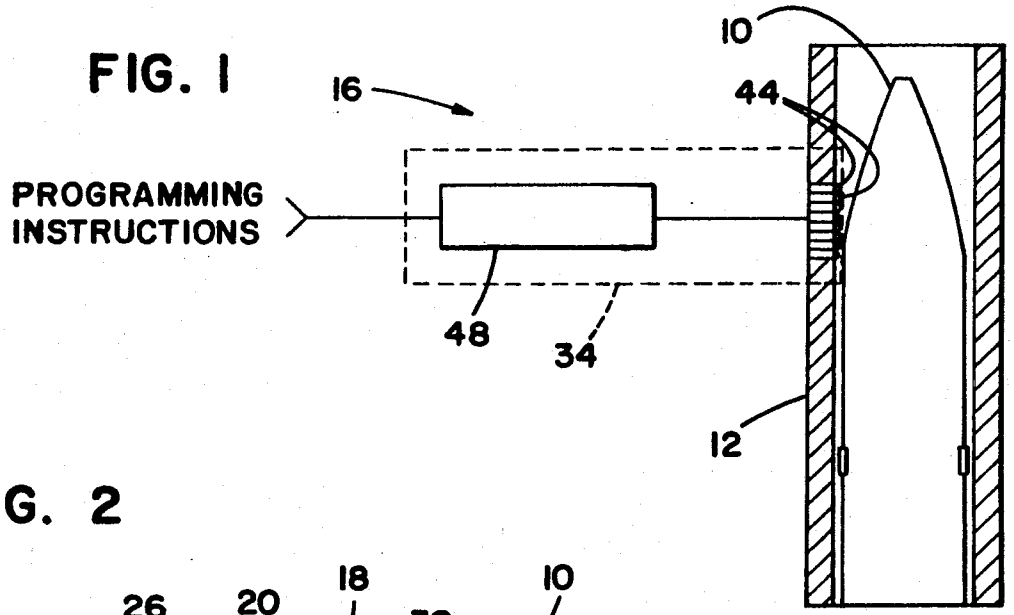
FIG. 1 is a schematic view of an implementation of a powerless programmable fuze function mode system of the present invention.
Figure 2:
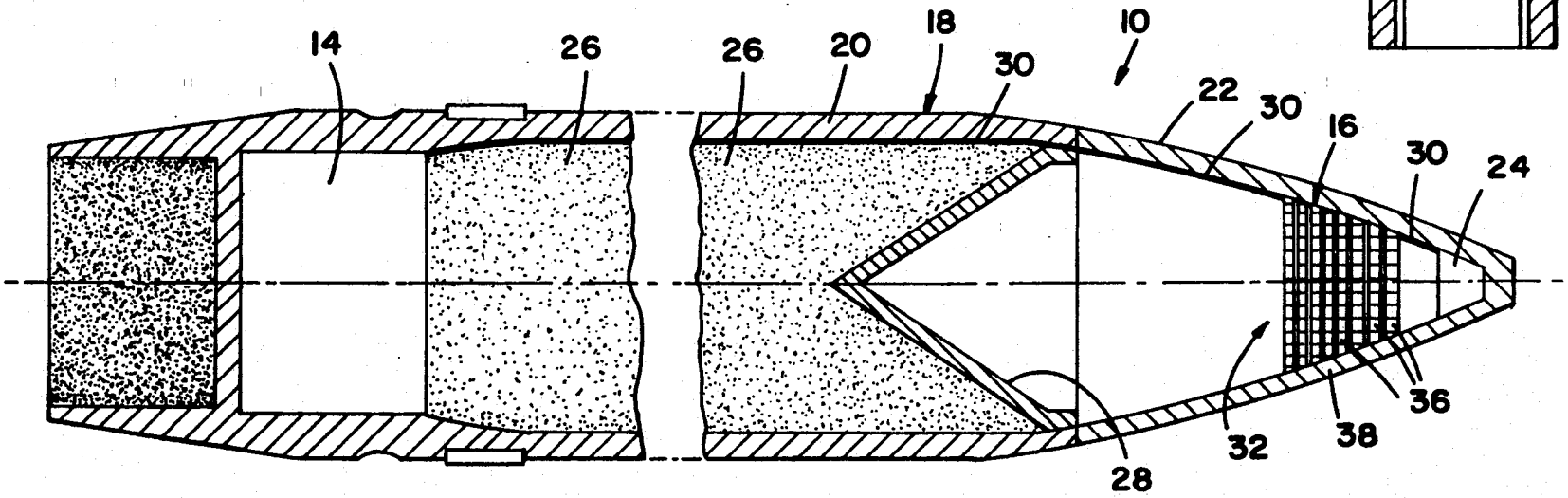
FIG. 2 is an enlarged longitudinal axial section of a munition incorporating a plurality of programmable elements of the powerless programmable system of the present invention in the form of a series of electrically conductive concentric bands attached to the interior of the munition casing.

Referring now to the drawings, and particularly to FIGS. 1 and 2, there is illustrated a munition 10 disposed in a loading tube 12 where the function mode of a fuze 14 of the munition 10 can be programmed by use of a powerless programmable system 16 of the present invention without the necessity of first having to supply electrical power to the fuze. The loading-tube 12 is located upstream of the firing chamber of a gun or launcher (not shown) so that programming of the fuze 14 of the munition 10 can be accomplished immediately before the munition 10 is loaded in the firing chamber.

Except for the addition of components of the powerless programming system 16, the munition 10 is of conventional construction and thus need not be described in detail. Suffice it to say that the munition 10 has an outer cylindrical casing 18 composed of an elongated body 20 and a tapered ogive or nose 22 which closes the forward end of the casing body 20. The munition 10 can be of the type having an impact crush switch 24 in the forward tip of the nose 22 and the fuze 14 disposed in the casing body 20 rearwardly of a high explosive propellant charge 26. The charge 26 is disposed in the casing body 20 aft of a shaped charge liner 28 located at the interface between the casing body 20 and nose 22. Electrical conductors 30 are inlaid in the casing 18 extending to the rear fuze 14 from the impact crush switch 24 and components of the powerless programmable system 16 contained in the nose 22 of the munition 10 such that when electrical power is generated after firing of the munition the function mode of the fuze programmed into the components of the system 16 can be electrically read and transmitted to the munition fuze 14.

Referring to FIGS. 1 and 2, basically, the powerless programming system 16 of the present invention includes programmable means 32 located on and internally of the munition casing 18, and a programming mechanism 34 located externally of the munition casing 18. The programmable means 32 are capable of being engaged by the programming mechanism 34 for presetting the function mode of the munition fuze 14. The programming mechanism 34 is operable for supplying mechanical, as opposed to electrical, power to the programmable means to cause programming thereof. Thus, the programming mechanism 34 can preset the function mode of the munition fuze in the programmable means 32 without the necessity of supplying electrical power thereto.

Figure 3:
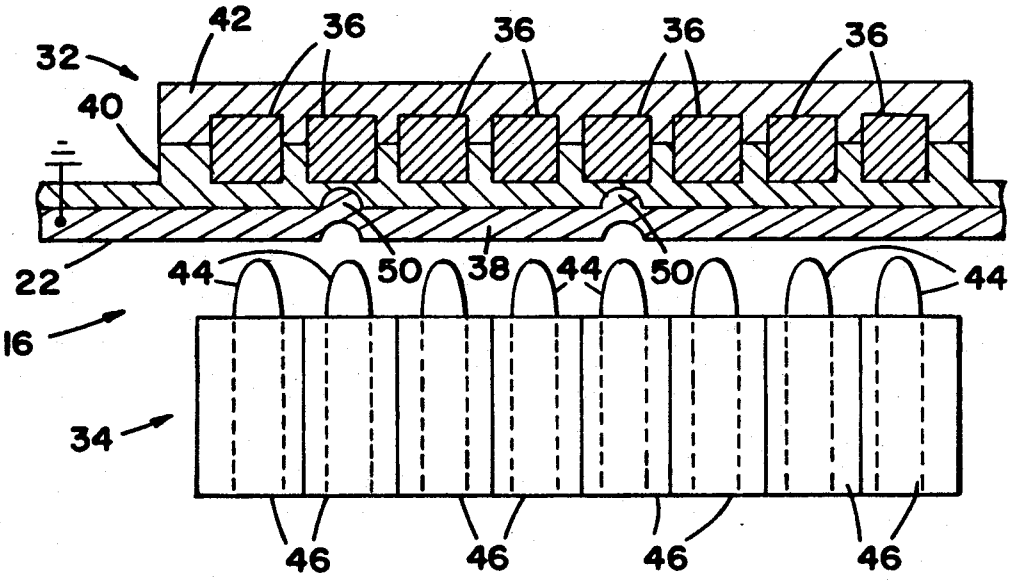
FIG. 3 is an enlarged view of the portion enclosed by circle 3—3 of FIG. 1.

Referring to FIGS. 2 and 3, the programmable means 32 of the powerless system 16 including an arrangement of programmable elements in the form of electrically conductive concentric rings or bands 36, an annular portion 38 of the munition casing nose 22, and an electrically insulating layer 40 attached to the interior of the annular portion 38 of the munition casing nose 22. The insulating layer 40 supports the programmable concentric bands 36 in spaced relation to one another axially along the annular portion 38 of the munition casing nose 22 and inwardly of the annular portion 38. Also, an inner structural ring 42 composed of nonconductive material is preferably disposed in the interior of the munition casing nose 22 inwardly of and over the concentric bands 36.

Referring to FIGS. 1 and 3, the programming mechanism 34 includes a series of punch heads 44 and drivers 46 supporting the punch heads 44 for reciprocal movement. The mechanism 34 also includes a controller 48 connected to the drivers 46. The punch heads 44 and drivers 46 are disposed along the exterior of the annular portion 38 of the munition casing nose 22 with the heads 44 aligned with the concentric bands 36. The controller 48 receives data instructions as to how the concentric bands 36 are to be programmed. The programming instructions can emanate from any suitable source, for example, from a keyboard, an artillery computer, manual programming, or a laser ranger finder.

The controller 48 converts the programming instructions to signals that are transmitted in parallel simultaneously to the drivers 46 causing actuation of selected ones of the drivers 46 simultaneously to move corresponding ones of the punch heads 44 to program the preselected ones of the bands 36. The other drivers 46 and punch heads 44 which are not selected are not actuated. The selected punch heads 44 when actuated by the drivers 46 strike the exterior of the annular portion 38 of the munition casing nose 22 causing an indentation 50 therein that penetrates the insulating layer 40 and makes electrical contact with the preselected ones of the programmable conductive concentric bands 36 aligned with the selected punch heads 44. By way of example, the punch heads 44 and drivers 46 can take the form of a dot matrix printer mechanism.

The inner structural ring 42 engages the bands 36 so as to resist deformation of the bands when the indentations 50 are produced in the annular portion 38 of the munition casing nose 22. The presence of the structural ring 42 ensures penetration of the insulating layer 40 by the indentations 50 and making of electrical contact by the annular portion 38 of the munition casing nose 22 with the preselected ones of the bands 36.

Figure 4:
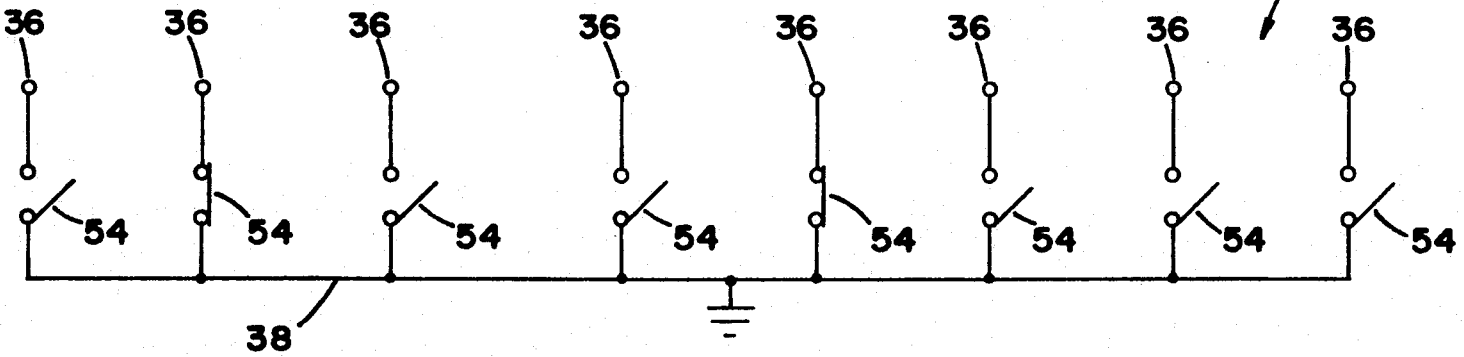
FIG. 4 is an electrical circuit equivalent to the state of the programmed concentric bands of FIG. 3.

Referring to FIG. 4, there is illustrated a simplified electrical circuit 52 which is equivalent to a circuit formed by the state of the programmed concentric bands 36, the munition casing nose annular portion 38, and the presence or absence of the indentations 50 which are comparable to closed or opened switches 52. The annular portion 38 of the munition casing nose 22 is maintained at a common electrical potential such that electrical contact made by the annular portion 38 with selected ones of the bands 36 and not made with the others thereof produces a coded binary sequence of opened and closed switches 52 that presets the function mode of the fuze 14 for reading subsequently once electrical power is generated upon munition firing. The programmed function mode of the fuze 14 can be, but is not limited to, the time of flight, height of burst, depth of penetration, or spin rate deployment.

The provision of the conductive bands 36 in circular, concentric arrangements avoids alignment or orientation requirements so that the indentation 50 is simply required through the insulating layer 40 anywhere along the band 36 in order to make electrical contact. Since the indentation 50 is a permanent deformation the contact is not susceptible to vibration. Additionally, the deformation action will tend to wipe oxide off the electrical contacts which is common to mechanical contact switches.

Once electrical power is available, the fuze logic will read the state of the bands 36 with respect to the common potential. The outer skin or casing of the munition 16 is placed at a common potential to avoid electrical noise problems associated with the launch of the munition.

It is thought that the present invention and its advantages will be understood from the foregoing description and it will be apparent that various changes may be made thereto Without departing from its spirit and advantages, the form hereinbefore described being merely preferred or exemplary embodiment thereof.

Having thus described the invention, what is claimed is:

1. In combination with a munition having a casing, a propellant explosive, and a fuze, an electrically powerless system that programs a function mode of said munition fuze for igniting said propellant explosive of said munition, said system comprising:

(a) programmable means that may be oriented at a plurality of rotational angles about a longitudinal axis of said programmable means for presetting the function mode of said fuze, said programmable means including an arrangement of programmable elements located internally of said munition casing, said programmable elements being electrically conductive but remaining electrically unpowered until after firing of said munition; and (b) a programming mechanism located externally of said munition casing, said mechanism being operable for supplying mechanical power to said programmable means to cause programming of said conductive elements to selectively provide one of a plurality of binary sequences and thereby preset data relating to a desired function mode of said fuze without the necessity of supplying electrical power to said conductive elements.

2. The system of claim 1 wherein said programmable means further includes:

an annular portion of said munition casing; and an electrically insulating layer attached to the interior of said annular portion of said munition casing, said insulating layer supporting said programmable elements in spaced relation to one another axially along said annular portion of said munition casing and inwardly of said annular portion.

3. The system of claim 2 wherein said arrangement of programmable elements is a series of electrically conductive concentric bands.

4. The system of claim 2 wherein said programming mechanism includes:

a plurality of punch heads; and a plurality of drivers movably mounting said punch heads and being disposed along the exterior of said annular portion of said munition casing and aligning said punch heads with said programmable elements, said punch heads capable of being actuated by said drivers such that only selected ones of said punch heads will strike the exterior of said annular portion of said munition casing causing an indentation therein that penetrates said insulating layer and makes electrical contact of said casing with said programmable elements aligned with said selected punch heads.

5. The system of claim 4 further comprising:

a structural ring disposed in the interior of said munition casing inwardly of an over said programmable elements and engaged therewith so as to resist deformation of said programmable elements due to actuation of said programming mechanism in producing said indentations in said annular portion of said munition casing and thereby ensure penetrating of said insulating layer of said indentations and making of electrical contact by said annular portion of said munition casing with selected ones of said programmable elements.

6. The system of claim 4 wherein said annular portion of said munition casing is maintained at a common electrical potential such that electrical contact made by said annular portion with selected ones of said programmable elements and not made with the others thereof produces a coded binary sequence of opened and closed switches that presets the function mode of said fuze for reading subsequently once electrical power is generated upon munition firing.

7. The system of claim 4 wherein said programming mechanism further includes a controller for receiving data instructions and being operable for actuating said drivers to actuate the selected ones of said punch heads and not actuate the others of said punch heads which were not selected.

8. In combination with a munition having a casing, a propellant explosive, and a fuze, an electrically powerless system that programs a function mode of said munition fuze for igniting said propellant explosive of said munition, said system comprising:

(a) programmable means for presetting of data relating to the function mode of said munition fuze, said programmable means including (i) an arrangement of concentric bands located internally of said munition casing, said bands being electrically conductive but remaining electrically passive until after firing of said munition, (ii) an annular portion of said munition casing, and (iii) an electrically insulating layer attached to the interior of said annular portion of said munition casing, said insulating layer supporting said concentric bands in spaced relation to one another axially along said annular portion of said munition casing and inwardly of said annular portion; and (b) a programming mechanism located externally of said munition casing, said mechanism being operable for supplying mechanical power to said programmable means to cause programming of said conductive bands of said programmable means and thereby presetting of data relating to the function mode of said fuze without the necessity of supplying electrical power to said bands.

9. The system of claim 8 wherein said programming mechanism includes:

a plurality of punch heads; and a plurality of drivers movably mounting said punch heads and being disposed along the exterior of said annular portion of said munition casing and aligning said punch heads with said programmable elements, said punch heads capable of being actuated by said drivers such that only selected ones of said punch heads will strike the exterior of said annular portion of said munition casing causing an indentation therein that penetrates said insulating layer and makes electrical contact of said casing with said programmable elements aligned with said selected punch heads.

10. The system of claim 8 further comprising:

a structural ring disposed in the interior of said munition casing inwardly of an over said concentric bands and engaged therewith so as to resist deformation of said bands due to actuation of said programming mechanism in producing said indentations in said annular portion of said munition casing and thereby ensure penetrating of said insulating layer by said indentations and making of electrical contact by said annular portion of said munition casing with selected ones of said bands.

11. The system of claim 8 wherein said annular portion of said munition casing is maintained at a common electrical potential such that electrical contact made by said annular portion with selected ones of said bands and not made with the others thereof produces a coded binary sequence of opened and closed switches that presets the function time of said fuze for reading subsequently once electrical power is generated upon munition firing.

12. The system of claim 9 wherein said programming mechanism further includes a controller for receiving data instructions and being operable for actuating said drivers to actuate the selected ones of said punch heads and not actuate the others of said punch heads which were not selected.

* * * * *

UNITED STATES PATENT AND TRADEMARK OFFICE

CERTIFICATE OF CORRECTION

PATENT NO. : 5,160,801
DATED : November 3, 1992
INVENTOR(S) : David A. Andersen, et. al.

It is certified that error appears in the above-indentified patent and that said Letters Patent is hereby corrected as shown below:

Column 5, line 39, cancel "an" and substitute --and--.
Column 5, line 45 cancel "of" in the second occurrence and substitute --by--.
Column 6, line 42 cansel "an" and substitute --and--.

Signed and Sealed this

Twenty-first Day of December, 1993

*Attest:*

Bruce Lehman

BRUCE LEHMAN

*Attesting Officer*

*Commissioner of Patents and Trademarks*